US007344358B2

(12) United States Patent
Lu et al.

(10) Patent No.: US 7,344,358 B2
(45) Date of Patent: Mar. 18, 2008

(54) FAN ASSEMBLY AND FAN FRAME THEREOF

(75) Inventors: Lobato Lu, Taoyuan Hsien (TW); Ke-Nan Wang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 174 days.

(21) Appl. No.: 10/974,738

(22) Filed: Oct. 28, 2004

(65) Prior Publication Data

US 2006/0002790 A1 Jan. 5, 2006

(30) Foreign Application Priority Data

Jun. 30, 2004 (TW) ..... 93119410

(51) Int. Cl.
*F01D 1/04* (2006.01)

(52) U.S. Cl. ..... 415/211.2; 417/423.15

(58) Field of Classification Search ..... 415/191, 415/207, 208.1, 208.2, 211.2; 361/695; 417/352, 417/353, 354, 423.15; 416/247 R
See application file for complete search history.

(56) References Cited

U.S. PATENT DOCUMENTS

| | | | | |
|---|---|---|---|---|
| 2,142,307 | A * | 1/1939 | De Mey et al. | 417/423.15 |
| 2,661,894 | A * | 12/1953 | Stevenson et al. | 417/353 |
| 2,854,188 | A * | 9/1958 | Shomphe | 417/313 |
| 3,261,544 | A * | 7/1966 | Guichard | 416/171 |
| 3,775,029 | A * | 11/1973 | Ranz | 417/353 |
| 5,246,339 | A * | 9/1993 | Bengtsson et al. | 415/208.1 |
| 5,522,457 | A * | 6/1996 | Lenz | 165/121 |
| 6,547,540 | B1 * | 4/2003 | Horng et al. | 417/423.14 |
| 6,808,411 | B2 * | 10/2004 | Chen | 439/485 |
| 6,912,127 | B2 * | 6/2005 | Hutchinson et al. | 361/695 |

* cited by examiner

*Primary Examiner*—Edward K. Look
*Assistant Examiner*—Devin Hanan
(74) *Attorney, Agent, or Firm*—Birch, Stewart, Kolasch & Birch, LLP

(57) ABSTRACT

A fan assembly and fan frame thereof. A housing includes an opening. A motor base is disposed in the housing. A plurality of ribs are disposed in the opening and between the housing and the motor base for supporting the motor base. Each rib has a varied cross section from the motor base to the housing.

26 Claims, 7 Drawing Sheets

FAN ASSEMBLY AND FAN FRAME THEREOF

This Nonprovisional application claims priority under 35 U.S.C. § 119(a) on patent application Ser. No(s). 093119410 filed in Taiwan, Republic of China on Jun. 30, 2004, the entire contents of which are hereby incorporated by reference.

BACKGROUND

The invention relates to a fan assembly, and in particular to a fan assembly and fan frame thereof.

Electronic devices generally produce heat during operation, and thus a demand exists for effective heat-dissipation devices. If a heat-dissipation device cannot effectively dissipate excess heat generated by the electronic device, performance can suffer, and more seriously, the electronic device may be burned out at high temperature. Moreover, since the number of transistors per unit area in an electronic device increases to improve performance, available internal space is reduced, and high temperature is concentrated therein such that performance deteriorates. Thus, an effective heat-dissipation device is an important component in micro-electronic devices such as integrated circuits (ICs).

The most popular heat-dissipation system is fan assembly. A fan assembly comprises a fan frame, hub, blades and motor. As shown in FIGS. 1A and 1B, conventional fan frames 11*a* and 11*b* are connected to motor bases 12*a* and 12*b* via a plurality of ribs 13*a* and 13*b*, respectively. The ribs 13*a* and 13*b* support the motor bases 12*a* and 12*b*. The ribs 13*a* and 13*b* can be cylindrical, curved, or streamlined. For example, the cross section of the rib 13*a* along line A-A of FIG. 1A is triangular, as shown in FIG. 1A-1; the cross section of the rib 13*b* along line B-B of FIG. 1B is circular, as shown in FIG. 1B-1, or is rectangular, as shown in FIG. 1B-2. Regardless of the shape of rib cross section, however, the ribs 13*a* and 13*b* have an identical linear shape extending from the motor bases 12*a* and 12*b* toward the fan frame 11*a* and 11*b*, respectively.

As shown in FIG. 1C, if the ribs 13 connected to the motor base 12 and the fan frame 11 are curved, the cross section thereof is not continuous. The side view of the rib 13, however, is fully shown in the figure for clear explanation of the fan frame 11*a* or 11*b*. The blades 14 of the fan 10 are radially arranged on an outer periphery of the hub 15 with a motor (not shown) disposed therein.

When the blades 14 rotate, since the ribs 13 with the same cross section extend linearly along the motor base 12 toward the fan frame 11, the lower edge of the blades 14 are parallel to the ribs 13. As the size of the fan assembly is reduced, noise is produced due to airflow resistance between the lower edge of the blades 14 and the ribs 13. Additionally, the noise level increases with the fan speed.

SUMMARY

Embodiments of the invention provide a fan assembly and fan frame thereof comprising ribs with varied cross sections such that the noise level between the blades and fan frame can be reduced.

Also provided is a fan frame comprising a housing, a motor base, and a plurality of ribs. The housing comprises an opening. The motor base is disposed in the housing. The ribs are disposed between the opening and the motor base for supporting the motor base. The cross section of each rib is varied from the motor base to the housing. The width and thickness of each rib also vary from the motor base to the housing.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein:

FIG. 1A-1 is a cross section of the rib along line A-A of FIG. 1A;

FIGS. 1B-1 and 1B-2 are cross sections of the rib along line B-B of FIG. 1B;

FIGS. 3A-1, 3A-2, 3B-1, 3B-2, and 3C are cross sections of various fan assemblies according to an embodiment of the invention.

DETAILED DESCRIPTION

Figure 2A:
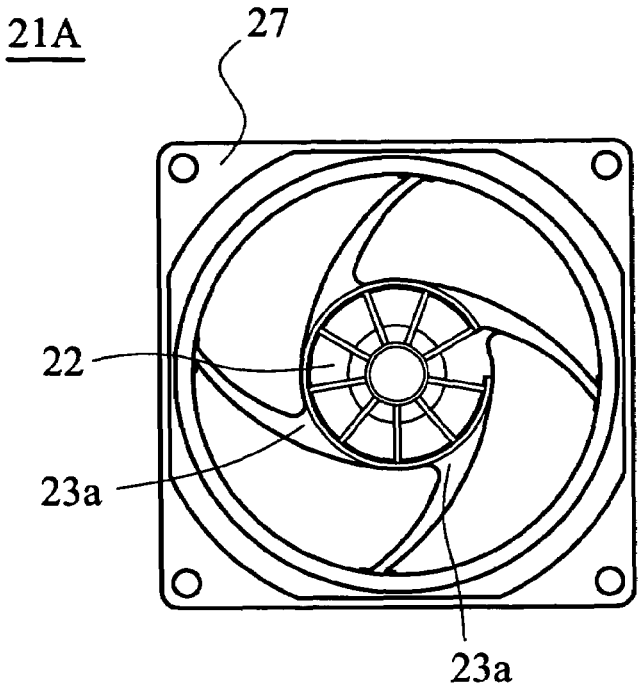
FIG. 2A is a schematic view of a fan frame according to an embodiment of the invention.
Figure 2B:
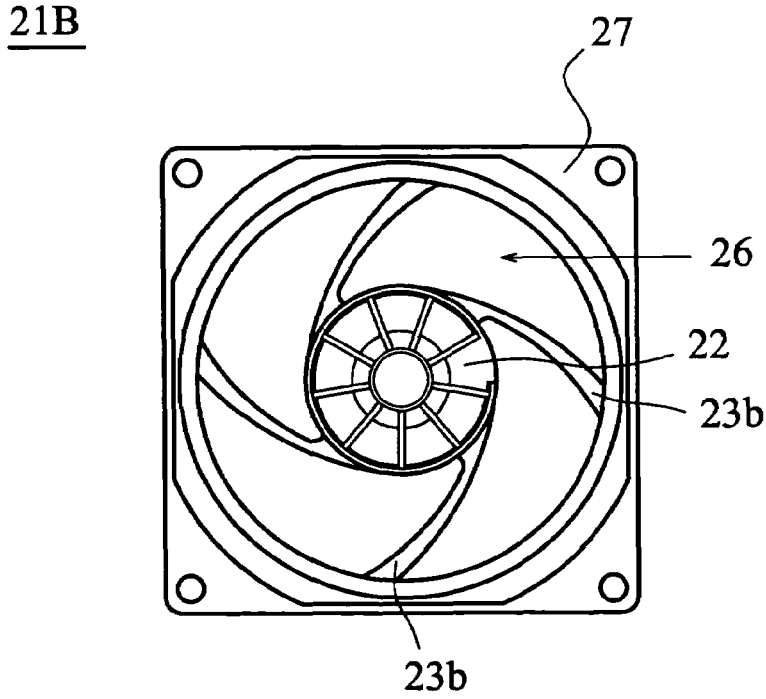
FIG. 2B is a schematic view of another fan frame according to another embodiment of the invention.

FIGS. 2A and 2B are schematic views of two fan frames according to embodiments of the invention. The fan frame 21 comprises a housing 27, a motor base 22, and a plurality of ribs 23. The housing 27 has an opening 26, and the motor base 22 is disposed in the opening 26. The ribs 23, for supporting the motor base 22, are disposed in the opening 26 and between the housing 27 and the motor base 22. The ribs 23 connecting the housing 27 and the motor base 22 are extended tangentially from the motor base 22 to the housing 27. The ribs can be cylindrical, curved, or streamlined.

Each rib 23 has a width along a direction perpendicular to an axial line of the motor base 22 varying from the motor base 22 to the housing 27. For example, as shown in FIG. 2A, the width of the part 23*a* of the rib 23 connecting to the motor base 22 is greater than the width of the rib 23 connecting to the housing 27 of the fan frame 21A. That is, the width of the rib 23 decreases from the motor base 22 to the housing 27. The variation in width can be a linear or non-linear (quadratic) variation. Moreover, as shown in FIG. 2B, another fan frame 21B has different parts 23*b* of the ribs 23 from the parts 23*a*. The width of the part 23*b* of the rib 23 connecting to the housing 27 is greater than the width of the rib 23 connecting to the motor base 22. That is, the width of the part 23*b* of the rib 23 increases linearly or non-linearly from the motor base 22 to the housing 27.

Furthermore, FIGS. 3A-1, 3A-2, 3B-1, 3B-2, and 3C are cross sections of various fan assemblies. Note that, when the arrangement of the ribs 23 is non-linear between the motor base 22 and the housing 27, the cross sectional view of the ribs 23 is not continuous and cannot be entirely seen in these figures. However, for clarity purpose, the ribs 23 are completely depicted in the figures. Also, the blades 24 are also clearly depicted but the actual cross section thereof cannot be entirely seen in the figures.

The fan assembly 20 comprises the fan frame 21, a hub 25, the blades 24 and a motor. The opening 26 of the housing 27 forms an inlet 211 and an outlet 212 on both ends of the fan frame 21. The motor base 22 is preferably located at a center of the opening 26 near the outlet 212.

The blades 24 of the fan 20 are radially connected to an outer periphery of the hub 25. The motor (not shown) is disposed in the hub 25. Each rib 23 has a varied thickness along an axial line of the motor base 22 from the motor base 22 to the housing 27. For example, the thickness of the rib 23 connecting to the motor base 22 is greater than that of the rib 23 connecting to the housing 27. Or, the thickness of the rib 23 gradually decreases from the motor base 22 to the housing 27, as shown in FIGS. 3A-1 and 3A-2.

Figure 1A:
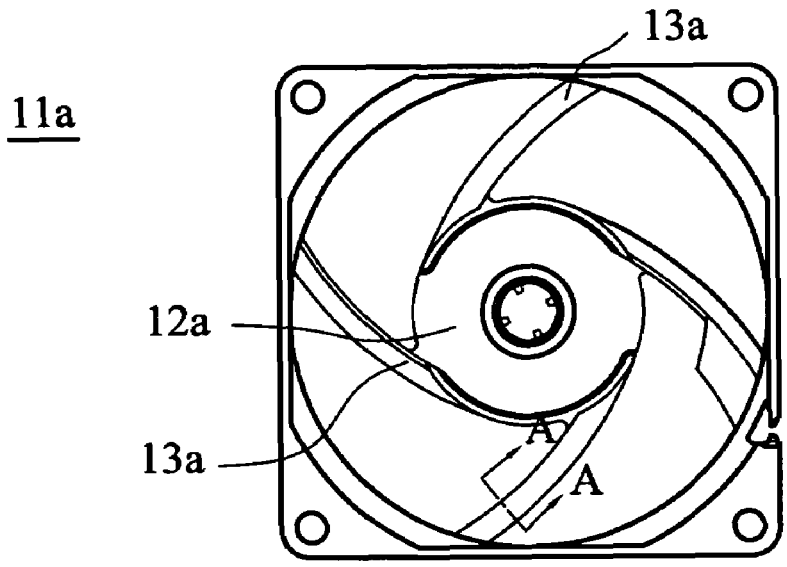
FIG. 1A ( RELATED ART )
FIG. 1A is a schematic plan view of a conventional fan frame.
Figures 1, 1A:
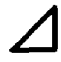
FIG. 1A-1 ( RELATED ART )
Figure 1B:
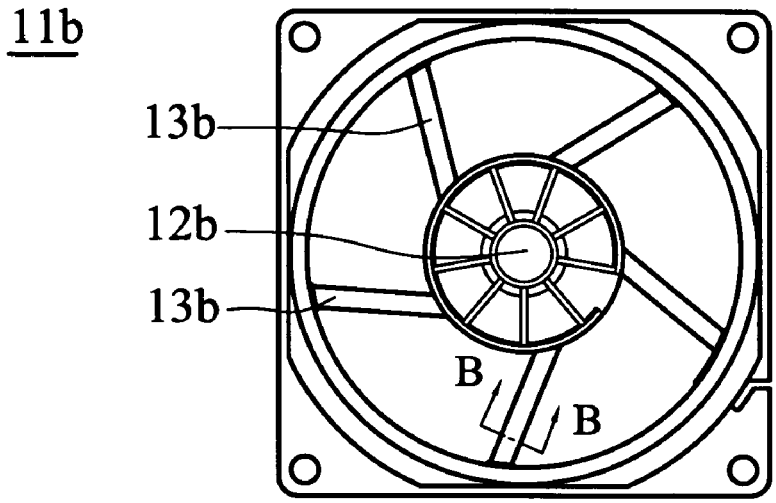
FIG. 1B ( RELATED ART )
FIG. 1B is a schematic plan view of another conventional fan frame.
Figures 1, 1B:
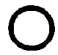
FIG. 1B-1 ( RELATED ART )
Figures 1, 1B, 2:
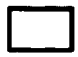
FIG. 1B-2 ( RELATED ART )
Figure 1C:
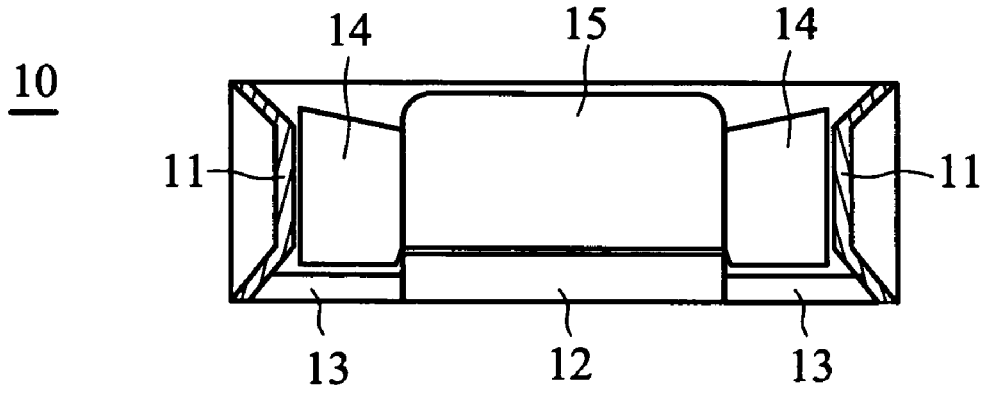
FIG. 1C ( RELATED ART )
FIG. 1C is a cross section of a conventional fan assembly.
Figures 1, 3A:
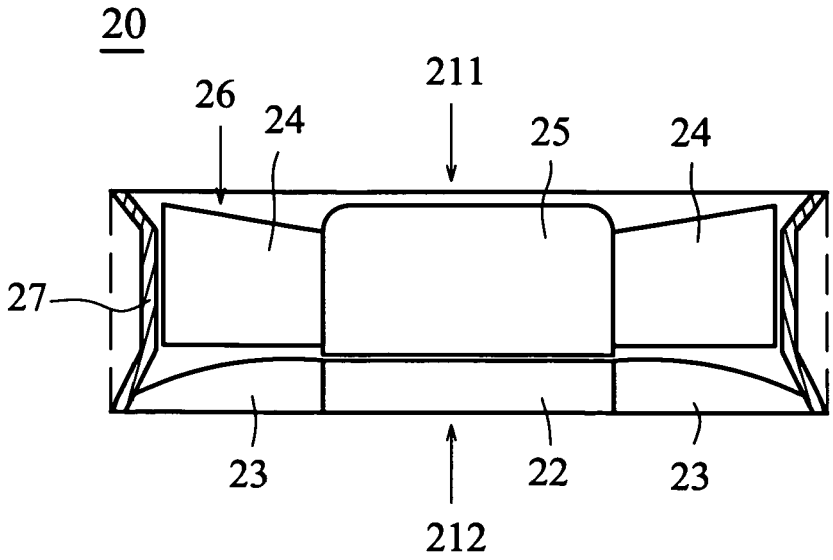
Figures 2, 3A:
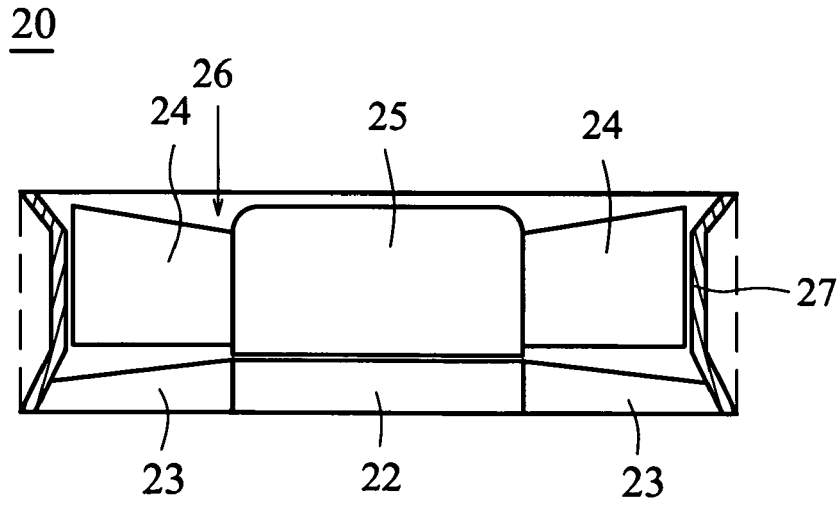
Figures 1, 3B:
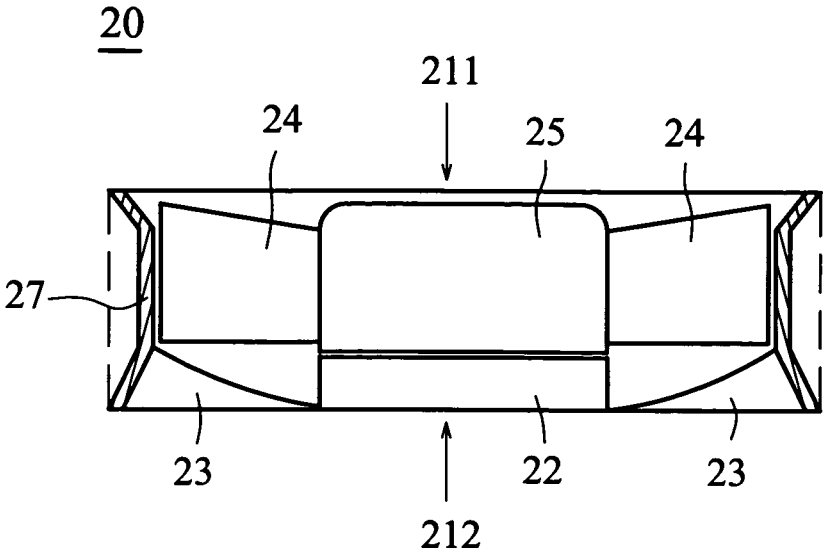
Figures 2, 3B:
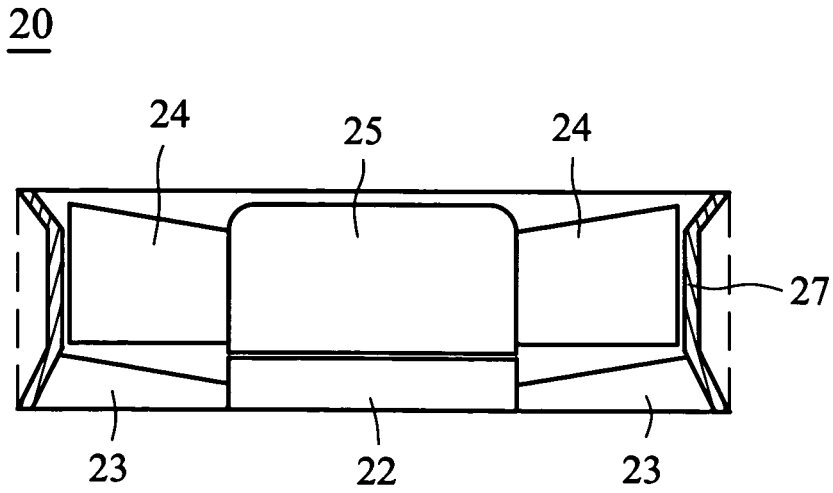
Figure 3C:
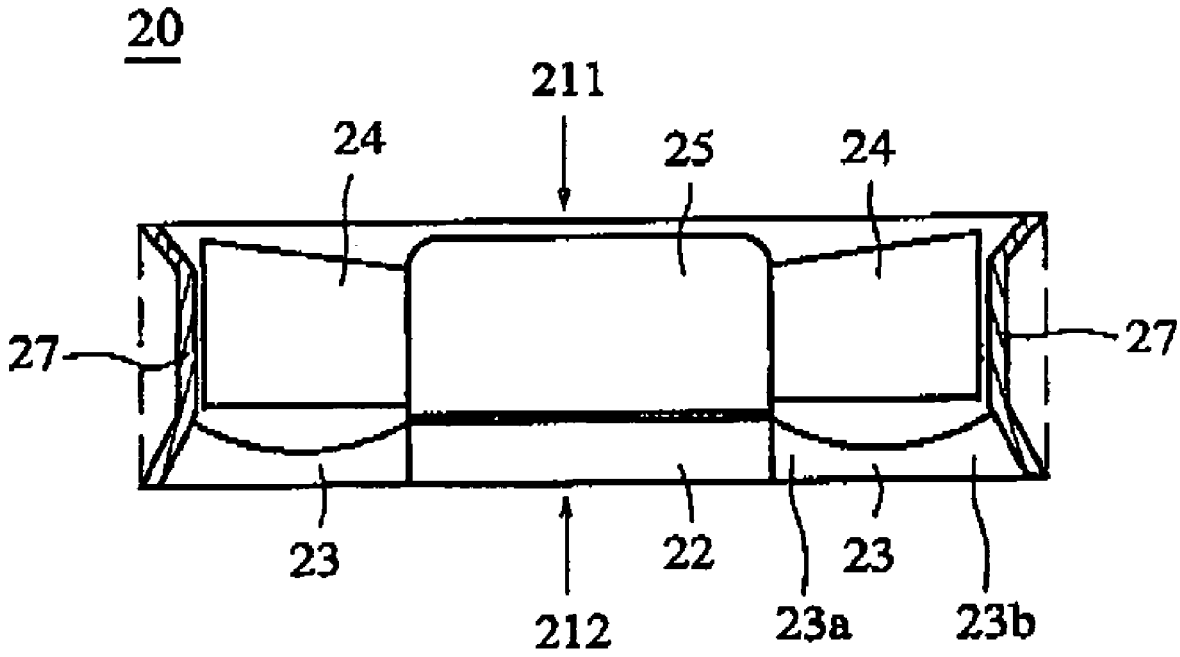

Alternatively, as shown in FIGS. 3B-1 and 3B-2, the thickness of the ribs 23 connecting to the motor base 22 is less than that of the ribs 23 connecting to the housing 27. Or, the thickness of the ribs 23 gradually increases from the motor base 22 to the housing 27.

In FIGS. 3A-1 and 3A-2, the thickness of the ribs respectively increases linearly or non-linearly; In FIGS. 3B-1, and 3B-2, the thickness of ribs respectively decreases linearly or non-linearly.

Furthermore, the thickness of ribs can be varied non-linearly. That is, each rib 23 has a maximum or minimum thickness at a portion of the rib 23 connecting to the housing 27, a portion of the rib 23 connecting to the motor base 22, or a location therebetween. For example, in FIG. 3C, each rib 23 with a concave cross section has a maximum thickness near the housing 27 and the motor base 22.

During rotation of the blades 24, airflow speed increases outwardly from the blades 24. That is, the flow speed near the housing 27 is faster than the speed near the motor base 22. Since each rib 23 has a varied width from the motor base 22 to the housing 27 in the blade rotational direction, flow resistance at the rib 23 near the housing 27 can be reduced, thereby reducing noise. Moreover, since each rib 23 has a varied thickness, the distance between the ribs 23 and the lower edge of the blades 24 can be varied. This reduces interference between the ribs 23 and the blades 24 during rotation, reducing flow resistance and reducing noise level.

The width of each rib 23 is designed according to the rotational direction of the blades 24. The thickness of the narrower portion of the rib 23 can be increased, ensuring the strength of the ribs 23. For example, as shown in FIG. 2A, the width of each part 23*a* connecting to the motor base 22 is greater than that of each rib 23 connecting to the housing 27. Additionally, varied thickness design is applied to each part 23*a* so that the part 23*a* connecting to the housing 27 is thicker than the rib 23 connecting to the motor base 22, as shown in FIG. 3B-1 or FIG. 3B-2.

In another embodiment of the invention, as shown in FIG. 2B, the width of each part 23*b* connecting to the housing 27 is greater than that of each rib 23 connecting to the motor base 22. Additionally, varied thickness design is applied to each part 23*b* so that the part 23*b* connecting to the motor base 22 is thicker than the rib 23 connecting to the housing 27, as shown in FIG. 3A-1 or FIG. 3A-2.

Variation in width and thickness of the ribs 23 can be linear or non-linear. Thus, each rib 23 has a varied cross section from the motor base 22 to the housing 27, preventing noise due to flow resistance between the lower edge of the blades and the ribs. The housing 27 can be substantially rectangular, circular, elliptical, rhomboid, or similar.

A noise test, comparing a conventional fan with a fan assembly according to an embodiment of the invention, was performed. The experiments revealed in a noise frequency range produced by the blades of the invention, a relative prominent noise ratio can be lowered. In one of the experimental results, in a noise frequency range of 200-2000 Hz, the relative prominent noise ratio of a conventional fan was 20 dB, while the relative prominent noise ratio of an embodiment of the invention can be reduced to 5 dB. Thus, noise can be effectively lowered because of the varied cross section of the ribs, further reducing the noise produced between the blades and the fan frame.

The invention is not limited to the disclosed embodiments or those skilled in the art disclosed, but is to be accorded the widest scope consistent with the principles and features disclosed herein. Not only the cross section of the ribs 23 can be varied, the inner surface of the housing 27 and the outer periphery of the blades 24 can also be curved. That is, the housing 27 can be curved inward. The curved blades 24 increase contact area by effectively blocking the gap between the blades 24 and the housing 27, providing improved heat dissipation and reduced noise level. The fan assembly 20 may also block light due to the curved shape of the blades.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An axial fan frame comprising:

a housing having an opening;

a motor base disposed in the housing; and a plurality of ribs disposed in the opening and extended tangentially from the motor base to the housing for supporting the motor base, wherein each rib has a cross section varied continuously from the motor base to the housing to reduce flow resistance at the rib.

2. The axial fan frame as claimed in claim 1, wherein a width along a direction perpendicular to an axial line of the motor base of each rib is varied from the motor base to the housing.

3. The axial fan frame as claimed in claim 2, wherein the width gradually increases or decreases from the motor base to the housing.

4. The axial fan frame as claimed in claim 1, wherein a width along a direction perpendicular to an axial line of the motor base of each rib connecting to the motor base is greater than that of each rib connecting to the housing.

5. The axial fan frame as claimed in claim 1, wherein a width along a direction perpendicular to an axial line of the motor base of each rib connecting to the motor base is less than that of each rib connecting to the housing.

6. The axial fan frame as claimed in claim 1, wherein a thickness along an axial line of the motor base of each rib is varied from the motor base to the housing.

7. The axial fan frame as claimed in claim 6, wherein the thickness gradually increases or decreases from the motor base to the housing.

8. The axial fan frame as claimed in claim 1, wherein a thickness along an axial line of the motor base of each rib connecting to the motor base is less than that of each rib connecting to the housing.

9. The axial fan frame as claimed in claim 1, wherein thickness along an axial line of the motor base of each rib connecting to the motor base is greater than that of each rib connecting to the housing.

10. The axial fan frame as claimed in claim 1, wherein each rib has a curved surface or an inclined surface.

11. The axial fan frame as claimed in claim 1, wherein the varied cross section gradually increases or decreases from the motor base to the housing.

12. An axial fan assembly, comprising:

a fan frame, including:

a common housing having an opening;

a motor base disposed in the housing; and a plurality of ribs disposed in the opening and extended tangentially between the common housing and the motor base for supporting the motor base, wherein each rib has a cross section varied continuously from the motor base to the common housing to reduce flow resistance at the rib;

an impeller disposed corresponding to the fan frame; and a motor supported by the motor base;

wherein the impeller, the motor base and the ribs are disposed within the common housing.

13. The axial fan assembly as claim in claim 12, wherein the opening forms an inlet and an outlet at two ends of the common housing, and the motor base and the ribs are located at the outlet.

14. The axial fan assembly as claimed in claim 12, wherein the impeller comprises a hub disposed at the motor base, and a plurality of blades, each blade respectively connecting to the hub.

15. The axial fan assembly as claimed in claim 12, wherein a width along a direction perpendicular to an axial line of the motor base of each rib is varied from the motor base to the common housing.

16. The axial fan assembly as claimed in claim 15, wherein the width along an axial line of the motor base gradually increases or decreases from the motor base to the housing.

17. The axial fan assembly as claimed in claim 12, wherein a width along a direction perpendicular to an axial line of the motor base of each rib connecting to the motor base is greater than that of each rib connecting to the common housing.

18. The axial fan assembly as claimed in claim 12, wherein a width along a direction perpendicular to an axial line of the motor base of each rib connecting to the motor base is less than that of each rib connecting to the common housing.

19. The axial fan assembly as claimed in claim 12, wherein a thickness along an axial line of the motor base of each rib is varied from the motor base to the common housing.

20. The axial fan assembly as claimed in claim 19, wherein the thickness gradually increases or decreases from the motor base to the common housing.

21. The axial fan assembly as claimed in claim 12, wherein a thickness along an axial line of the motor base of each rib connecting to the motor base is less than that of each rib connecting to the common housing.

22. The axial fan assembly as claimed in claim 12, wherein a thickness along an axial line of the motor base of each rib connecting to the motor base is greater than that of each rib connecting to the common housing.

23. The axial fan assembly as claimed in claim 12, wherein each rib has a curved surface or an inclined surface.

24. The axial fan assembly as claimed in claim 12, wherein the varied cross section gradually increases or decreases from the motor base to the common housing.

25. An axial fan frame comprising:

a housing having an opening;

a motor base disposed in the housing; and a plurality of ribs disposed in the opening and extended tangentially from the motor base to the housing for supporting the motor base, wherein each rib has a varied cross section from the motor base to the housing to reduce flow resistance at the rib;

wherein a width of each rib is varied from the motor base to the housing.

26. An axial fan assembly comprising:

a housing having an opening;

a motor base disposed in the housing; and a plurality of ribs disposed in the opening and extended tangentially from the motor base to the housing for supporting the motor base, wherein a cross section of the rib is symmetrically varied from a middle to two ends of the rib.

* * * * *